US006860273B2

(12) United States Patent
Thomas, Jr.

(10) Patent No.: US 6,860,273 B2
(45) Date of Patent: Mar. 1, 2005

(54) CIGARETTE WITH ADSORBENT AT TIP END THEREOF

(75) Inventor: Charles E. Thomas, Jr., Richmond, VA (US)

(73) Assignee: Philip Morris Incorporated, New York, NY (US)

( * ) Notice: Subject to any disclaimer, the term of this patent is extended or adjusted under 35 U.S.C. 154(b) by 0 days.

(21) Appl. No.: 10/280,473

(22) Filed: Oct. 25, 2002

(65) Prior Publication Data

US 2004/0079379 A1 Apr. 29, 2004

(51) Int. Cl.[7] ..... A24F 13/06; A24B 1/04

(52) U.S. Cl. ..... 131/201; 131/202; 131/203; 131/361; 131/363; 131/360

(58) Field of Search ..... 131/361, 363, 131/364, 362, 360, 201, 202, 203, 206

(56) References Cited

U.S. PATENT DOCUMENTS 3,297,038 A * 1/1967 Homburger ..... 131/337
3,494,366 A * 2/1970 Starbuck et al. ..... 131/10.5
3,605,756 A * 9/1971 Stewart ..... 131/339
4,793,365 A * 12/1988 Sensabaugh, Jr. et al. .. 131/194
4,924,886 A * 5/1990 Litzinger ..... 131/194

* cited by examiner

*Primary Examiner*—Dionne A. Walls
(74) *Attorney, Agent, or Firm*—Connolly Bove Lodge & Hutz LLP

(57) ABSTRACT

A zone or plug of porous adsorbent material, primarily activated carbon, is placed in the tobacco rod of a cigarette a short distance from the lighting end thereof. The amount of activated carbon is sufficient for effective removal of volatile smoke constituents while allowing the cigarette to burn continuously. The activated carbon traps volatile smoke constituents in close proximity to the burning coal in the first puffs of the cigarette. As the cigarette continues to burn, the burning coal consumes the activated carbon. The adsorbed smoke constituents are effectively removed without releasing them back into the mainstream smoke. Following the consumption of the activated carbon in the tobacco rod, the cigarette is unchanged from a cigarette of conventional design.

9 Claims, 1 Drawing Sheet

CIGARETTE WITH ADSORBENT AT TIP END THEREOF

BACKGROUND OF THE INVENTION

The present invention relates a cigarette with an adsorbent material at the tip end thereof, and more particularly to selective filtration of cigarette smoke by providing a zone or plug of porous adsorbent material at the lighting tip end of the cigarette.

The concentration of mainstream smoke constituents changes on a puff-by-puff basis starting with the lighting puff and progressing down the tobacco rod. It is desirable to selectively reduce certain compounds which occur at significantly higher concentrations in the first one or two puffs of a cigarette.

SUMMARY OF THE INVENTION

Accordingly, it is an object of the present invention to reduce the level of volatile smoke constituents in mainstream cigarette smoke.

Another object of the invention is the adsorption of volatile smoke constituents close to the burning coal of a cigarette where such constituents are formed.

In accordance with the present invention, a cigarette comprises a tobacco rod and an adjoining filter, such as a cellulose acetate tow. A zone or plug of porous adsorbent material is positioned in the tobacco rod a short distance from the lighting end thereof. The amount of adsorbent material is sufficient for effective removal of volatile smoke constituents while allowing the cigarette to burn continuously. The adsorbent material traps volatile smoke constituents in close proximity to the burning coal during the first puffs of the cigarette. As the cigarette continues to burn, the burning coal consumes the adsorbent material, and the adsorbed smoke constituents are thereby effectively removed without releasing them back into the mainstream smoke.

The zone or plug of porous adsorbent material may be activated carbon, and one or more spaced apart zones or plugs may be utilized. The activated carbon material may comprise a zone of carbon granules or a carbon plug in the form of a wafer. Preferably, the zones or plugs of absorbent material are spaced approximately 4 to 8 mm from the lighting end of the cigarette.

BRIEF DESCRIPTION OF THE DRAWINGS

Novel features and advantages of the present invention in addition to those mentioned above will become apparent to persons of ordinary skill in the art from a reading of the following detailed description in conjunction with the accompanying drawings wherein similar reference characters refer to similar parts and in which.

DETAILED DESCRIPTION OF THE INVENTION

Figure 1:
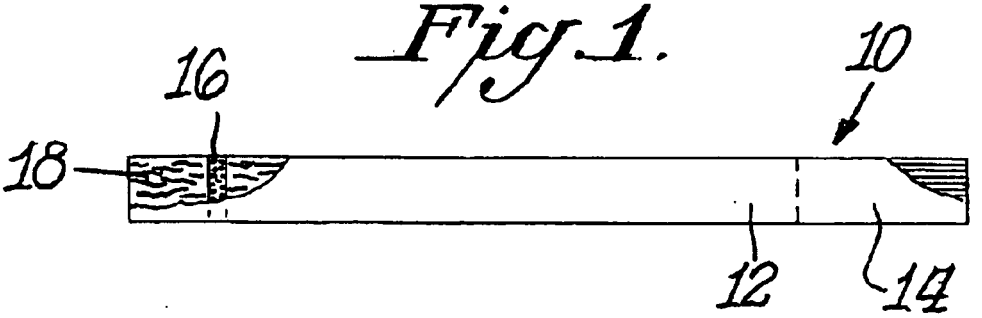
FIG. 1 is a side elevational view of cigarette with a zone or plug of adsorbent material at the tip end of the cigarette, according to the present invention, with portions broken away to illustrate interior details.

Referring in more particularity to the drawings, FIG. 1 illustrates a cigarette 10 comprising a tobacco rod 12 and an adjoining filter 14. As shown, the filter is a cellulose acetate tow although alternative filter arrangements may also be utilized, if desired. Cigarette 10 includes a zone or plug of porous adsorbent material 16 at the lighting end 18 of the tobacco rod. The porous adsorbent material may be activated carbon, either in the form of granules or carbon wafers and the material may be positioned a short distance from the lighting end 18, preferably about 4 to 8 mm.

The amount of adsorbent material 16 (about 20 to 50 mg, preferably 25 to 40 mg) is sufficient for the effective removal of volatile smoke constituents while allowing the cigarette 10 to burn continuously. The adsorbent material 16 traps volatile smoke constituents in close proximity to the burning coal in the first few puffs of the cigarette. As the cigarette 10 continues to burn, the burning coal consumes the adsorbent material to thereby effectively remove the adsorbed smoke constituents without releasing them back into the mainstream smoke. Following the consumption of the adsorbent material in the tobacco rod, cigarette 10 is unchanged from a cigarette of conventional design.

Figure 2:
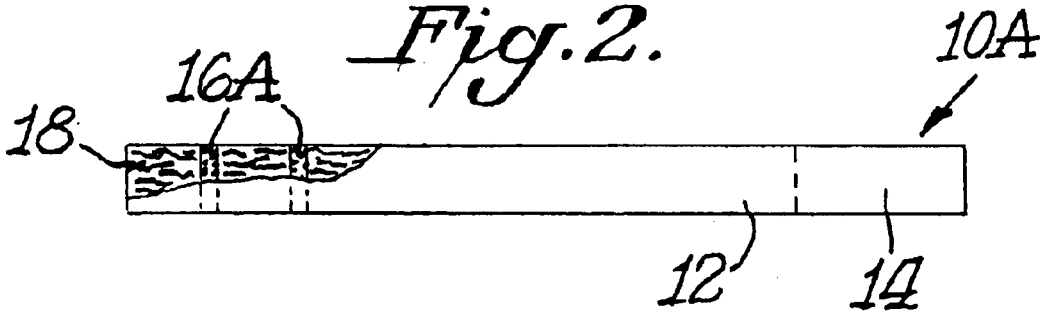
FIG. 2 is a side elevational view of another cigarette with several spaced apart zones or plugs of adsorbent material at the tip end of the cigarette, according to the present invention, with portions broken away to illustrate interior details.

FIG. 2 shows an alternate cigarette 10A comprising a tobacco rod 12 with an adjoining filter 14. Cigarette 10A includes two spaced apart zones or plugs of porous adsorbent material 16A at the lighting end 18 of tobacco rod 12. The porous adsorbent material 16A may be activated carbon, either carbon granules or carbon wafers, and the material may be positioned a short distance from the lighting end 18, preferably about 4 to 8 mm. Also the spacing between the plugs or zones of porous adsorbent material 16A may be about 4 to 8 mm. Each plug or zone 16A may comprise 20 to 50 mg of activated carbon, preferably about 25 to 40 mg. Otherwise cigarette 10A is the same as cigarette 10 and functions in the same manner as cigarette 10, as explained above.

Adding the adsorbent material 16, 16A to the tobacco rod in a discrete zone or plug provides for the adsorption of the volatile smoke constituents close to the burning coal where they are formed. Being heated due to the closeness of the hot coal, the adsorbent material is also more effective at adsorption of gases. After adsorption of the volatiles during the first two puffs, the adsorbent material is consumed with the surrounding tobacco through normal cigarette burning as the cigarette coal progresses through the adsorbent zones or plugs.

Another advantage is that the filter design and construction are unaffected. Also, following consumption of the adsorbent material, the cigarette is the same as a conventional cigarette, and there is a lower impact on smoke flavor when compared to a cigarette design that incorporates the adsorbent material in the filter.

The adsorbent zone or plug can also be used to affect the cigarette burn rate so the cigarette would self extinguish if not puffed thereby producing a cigarette of reduced ignition propensity.

Also, some aldehydes and dienes are produced in disproportionally high amounts in the first puff (lighting puff). By placing the adsorbent material so that it removes these compounds from the first few puffs after which the adsorbent is consumed, the overall subjectives of the cigarette are only minimally affected. At the same time, the total deliveries of target compounds such as 1, 3-butadiene and formaldehyde are significantly reduced.

After passing through the adsorption zone, the tobacco smoke and hot gases still sweep across the remaining tobacco rod where its flavors are added to the smoke. In a conventional carbon-filtered cigarette this would not be possible.

Experimental data is attached showing the effectiveness of cigarettes 10, 10A in adsorbing reducing volatile constituents from tobacco smoke.

The following test data in Table 1 compares a control cigarette (IR4F) with cigarettes A through D each of which comprises a tobacco rod 12 and cellulose acetate filter 14. The individual readings comprise percentages of the total smoke constituents delivered for each of cigarette puffs 1–8. Reduced amounts occur during the first few puffs of cigarettes B, C and D, each of which is an embodiment of the present invention. Cigarette A is not an embodiment of the present invention and simply comprises carbon granules dispersed amongst the tobacco over 4 mm from the lighting end. As indicated, the removal percentages with cigarette A are not as good as cigarettes B, C and D.

| | Control Cigarette IR4F | Cigarette A Tobacco Rod & Filter (25 mg activated carbon granules mixed with tobacco over 4 mm from end) | Cigarette B Tobacco Rod & Filter (FIG. 1) (25 mg activated carbon zone or plug 1 to 1.5 mm wide @ 4 mm from end) | Cigarette C Tobacco Rod & Filter (FIG. 1) (40 mg activated carbon zone or plug 2 mm wide @ 4 mm from end) | Cigarette D Tobacco Rod & Filter (FIG. 2) (two 25 mg zones or plugs each 1 to 1.5 mm wide @ 4 and 8 mm from end) |
|---|---|---|---|---|---|
| Formaldehyde puff 1 | 65.4 | 73.2 | 16.1 | 4.0 | 3.7 |
| Formaldehyde puff 2 | 18.7 | 21.0 | 8.6 | 4.6 | 3.3 |
| Formaldehyde puff 3 | 5.8 | 6.4 | 5.1 | 3.5 | 3.6 |
| Formaldehyde puff 4 | 2.6 | 3.4 | 3.8 | 1.9 | 2.8 |
| Formaldehyde puff 5 | 2.5 | 2.7 | 2.3 | 1.8 | 2.8 |
| Formaldehyde puff 6 | 1.8 | 1.2 | 2.2 | 2.1 | 1.9 |
| Formaldehyde puff 7 | 1.7 | 1.3 | 1.4 | 1.6 | 2.3 |
| Formaldehyde puff 8 | 1.3 | 1.2 | 1.5 | 1.6 | 2.8 |
| Totals | 99.8 | 110.4 | 41.2 | 21.1 | 23.1 |
| Acetaldehyde puff 1 | 10.1 | 7.2 | 4.2 | 0.6 | 0.7 |
| Acetaldehyde puff 2 | 12.2 | 10.7 | 7.2 | 2.1 | 2.8 |
| Acetaldehyde puff 3 | 11.5 | 9.3 | 9.2 | 5.2 | 5.1 |
| Acetaldehyde puff 4 | 12.7 | 10.0 | 11.5 | 7.6 | 8.0 |
| Acetaldehyde puff 5 | 13.6 | 11.0 | 11.7 | 10.3 | 11.3 |
| Acetaldehyde puff 6 | 11.8 | 14.1 | 10.9 | 14.2 | 10.7 |
| Acetaldehyde puff 7 | 13.6 | 15.9 | 10.5 | 13.6 | 12.7 |
| Acetaldehyde puff 8 | 14.6 | 13.6 | 9.6 | 10.9 | 15.2 |
| Totals | 100.0 | 91.9 | 74.8 | 64.4 | 66.2 |
| Acrolein puff 1 | 10.8 | 8.8 | 2.5 | 1.0 | 0.4 |
| Acrolein puff 2 | 13.3 | 12.6 | 4.5 | 14 | 1.6 |
| Acrolein puff 3 | 12.2 | 10.5 | 6.1 | 2.8 | 1.3 |
| Acrolein puff 4 | 12.6 | 9.6 | 9.1 | 5.3 | 5.2 |
| Acrolein puff 5 | 14.4 | 9.8 | 9.2 | 8.0 | 8.6 |
| Acrolein puff 6 | 12.7 | 14.3 | 9.8 | 14.2 | 10.4 |
| Acrolein puff 7 | 11.8 | 14.2 | 8.7 | 11.8 | 10.0 |
| Acrolein puff 8 | 12.4 | 12.6 | 8.9 | 10.2 | 13.5 |
| Totals | 100.2 | 92.3 | 58.8 | 54.8 | 51.2 |
| Acetone puff 1 | 6.3 | 4.4 | 2.0 | 0.2 | 0.3 |
| Acetone puff 2 | 10.9 | 9.5 | 5.7 | 1.4 | 1.1 |

-continued

| | Control Cigarette IR4F | Cigarette A Tobacco Rod & Filter (25 mg activated carbon granules mixed with tobacco over 4 mm from end) | Cigarette B Tobacco Rod & Filter (FIG. 1) (25 mg activated carbon zone or plug 1 to 1.5 mm wide @ 4 mm from end) | Cigarette C Tobacco Rod & Filter (FIG. 1) (40 mg activated carbon zone or plug 2 mm wide @ 4 mm from end) | Cigarette D Tobacco Rod & Filter (FIG. 2) (two 25 mg zones or plugs each 1 to 1.5 mm wide @ 4 and 8 mm from end) |
|---|---|---|---|---|---|
| Acetone puff 3 | 11.6 | 10.0 | 7.8 | 5.2 | 3.6 |
| Acetone puff 4 | 12.6 | 11.6 | 9.8 | 7.4 | 6.3 |
| Acetone puff 5 | 15.0 | 13.4 | 10.8 | 10.1 | 10.5 |
| Acetone puff 6 | 13.4 | 15.6 | 10.5 | 13.4 | 10.5 |
| Acetone puff 7 | 14.2 | 17.5 | 10.5 | 12.9 | 12.5 |
| Acetone puff 8 | 16.2 | 15.8 | 10.6 | 12.1 | 14.6 |
| Totals | 100.2 | 97.8 | 67.7 | 62.7 | 59.4 |
| Hydrogen cyanide puff 1 | 2.4 | 1.1 | 0.7 | 0.5 | 0.5 |
| Hydrogen cyanide puff 2 | 7.7 | 3.6 | 3.5 | 0.7 | 0.8 |
| Hydrogen cyanide puff 3 | 11.5 | 7.1 | 8.7 | 2.2 | 3.6 |
| Hydrogen cyanide puff 4 | 13.5 | 10.4 | 14.2 | 7.6 | 7.1 |
| Hydrogen cyanide puff 5 | 16.0 | 12.4 | 18.5 | 13.5 | 13.4 |
| Hydrogen cyanide puff 6 | 15.9 | 14.3 | 17.8 | 15.7 | 16.8 |
| Hydrogen cyanide puff 7 | 15.8 | 19.1 | 17.2 | 17.6 | 21.7 |
| Hydrogen cyanide puff 8 | 17.2 | 15.7 | 16.6 | 15.8 | 24.2 |
| Totals | 100.1 | 83.6 | 97.1 | 73.6 | 88.2 |
| 1.3-butadiene puff 1 | 16.9 | 14.5 | 6.2 | 0.2 | 1.0 |
| 1.3-butadiene puff 2 | 13.0 | 11.7 | 9.5 | 2.1 | 2.5 |
| 1.3-butadiene puff 3 | 9.8 | 8.0 | 8.2 | 5.0 | 4.8 |
| 1.3-butadiene puff 4 | 10.9 | 8.2 | 10.5 | 7.7 | 7.8 |
| 1.3-butadiene puff 5 | 11.9 | 9.2 | 10.8 | 8.9 | 9.5 |
| 1.3-butadiene puff 6 | 10.9 | 12.3 | 9.2 | 12.2 | 9.2 |
| 1.3-butadiene puff 7 | 12.9 | 13.0 | 9.10 | 13.0 | 10.9 |
| 1.3-butadiene puff 8 | 13.7 | 10.8 | 8.2 | 10.1 | 13.2 |
| Totals | 100.0 | 87.9 | 71.6 | 59.2 | 58.8 |
| Isoprene puff 1 | 4.8 | 4.2 | 2.7 | 0.2 | 1.1 |
| Isoprene puff 2 | 5.8 | 4.3 | 5.3 | 1.1 | 2.2 |
| Isoprene puff 3 | 5.5 | 3.6 | 5.0 | 3.2 | 5.1 |

-continued

| | Control Cigarette IR4F | Cigarette A Tobacco Rod & Filter (25 mg activated carbon granules mixed with tobacco over 4 mm from end) | Cigarette B Tobacco Rod & Filter (FIG. 1) (25 mg activated carbon zone or plug 1 to 1.5 mm wide @ 4 mm from end) | Cigarette C Tobacco Rod & Filter (FIG. 1) (40 mg activated carbon zone or plug 2 mm wide @ 4 mm from end) | Cigarette D Tobacco Rod & Filter (FIG. 2) (two 25 mg zones or plugs each 1 to 1.5 mm wide @ 4 and 8 mm from end) |
|---|---|---|---|---|---|
| Isoprene puff 4 | 16.5 | 13.6 | 17.0 | 10.6 | 11.0 |
| Isoprene puff 5 | 17.1 | 13.2 | 16.3 | 15.5 | 15.4 |
| Isoprene puff 6 | 14.9 | 16.8 | 13.6 | 19.4 | 16.1 |
| Isoprene puff 7 | 17.7 | 17.8 | 14.1 | 15.4 | 18.5 |
| Isoprene puff 8 | 18.3 | 15.3 | 13.0 | 13.3 | 21.4 |
| Totals | 100.6 | 88.8 | 87.0 | 78.8 | 90.7 |
| Benzene puff 1 | 10.1 | 6.4 | 2.3 | 0.3 | 0.6 |
| Benzene puff 2 | 11.7 | 9.7 | 8.7 | 2.9 | 1.3 |
| Benzene puff 3 | 11.6 | 9.8 | 10.8 | 8.8 | 6.4 |
| Benzene puff 4 | 12.7 | 10.4 | 11.9 | 10.8 | 10.3 |
| Benzene puff 5 | 14.0 | 11.7 | 12.5 | 12.7 | 12.9 |
| Benzene puff 6 | 12.7 | 12.8 | 10.8 | 13.2 | 11.9 |
| Benzene puff 7 | 13.0 | 14.5 | 10.8 | 13.0 | 13.1 |
| Benzene puff 8 | 14.3 | 13.3 | 10.7 | 13.0 | 14.3 |
| Totals | 99.9 | 88.5 | 78.5 | 74.8 | 70.8 |
| Toluene puff 1 | 3.4 | 1.8 | 1.1 | 0.3 | 0.4 |
| Toluene puff 2 | 8.7 | 6.5 | 4.9 | 2.1 | 0.7 |
| Toluene puff 3 | 10.9 | 9.7 | 9.2 | 7.5 | 3.9 |
| Toluene puff 4 | 13.0 | 12.1 | 11.7 | 10.8 | 7.8 |
| Toluene puff 5 | 15.0 | 13.3 | 12.4 | 12.5 | 10.8 |
| Toluene puff 6 | 15.6 | 13.7 | 12.4 | 13.4 | 11.5 |
| Toluene puff 7 | 15.2 | 16.3 | 12.5 | 15.1 | 13.9 |
| Toluene puff 8 | 17.5 | 17.1 | 13.8 | 16.4 | 15.5 |
| Totals | 99.3 | 90.5 | 78.0 | 78.0 | 64.6 |

What is claimed is:

1. A cigarette consisting essentially of a tobacco rod and an adjoining filter, and at least one zone or plug of porous adsorbent material in the tobacco rod at a lighting end thereof spaced inwardly therefrom, and wherein the zone or plug of adsorbent material is spaced 4 to 8 mm from the lighting end of the cigarette.

2. A cigarette as in claim 1 wherein the porous adsorbent material is activated carbon.

3. A cigarette as in claim 1 wherein the zone or plug of porous adsorbent material comprises about 20 to 50 mg of activated carbon.

4. A cigarette comprising a tobacco rod and an adjoining filter, and including a plurality of spaced apart zones or plugs of porous adsorbent material in the tobacco rod at a lighting end thereof spaced inwardly therefrom, and wherein the zone or plug of porous adsorbent material closest to the lighting end is spaced 4 to 8 mm from the lighting end of the cigarette.

5. A cigarette as in claim 4 wherein the porous adsorbent material of each zone or plug comprises activated carbon.

6. A cigarette as in claim 4 wherein each zone or plug of porous adsorbent material comprises 20 to 50 mg of activated carbon.

7. A cigarette comprising a tobacco rod and an adjoining filter, a plurality of spaced apart zones or plugs of porous adsorbent material in the tobacco rod at a lighting end thereof spaced inward by therefrom, and wherein the zones or plugs of adsorbent material are spaced apart 4 to 8 mm, and wherein the zone or plug of adsorbent material closest to the lighting end of the cigarette is spaced 4 to 8 mm therefrom.

8. A cigarette as in claim 7 wherein the porous adsorbent material is activated carbon.

9. A cigarette as in claim 7 wherein the zones or plugs of porous adsorbent material each comprise about 20 to 50 mg of activated carbon.

* * * * *